US005432971A

United States Patent [19]

Chung

[11] Patent Number: 5,432,971

[45] Date of Patent: Jul. 18, 1995

[54] FOLDABLE TOOTHBRUSH

[76] Inventor: Angelika Y. B. Chung, Wisdom Ct, 5 Hatton Rd., Hong Kong, Hong Kong

[21] Appl. No.: 256,464

[22] Filed: Oct. 5, 1994

[30] Foreign Application Priority Data

Jan. 6, 1992 [GB] United Kingdom ..... 9200154

[51] Int. Cl.[6] ..... A46B 15/00; A46B 9/10

[52] U.S. Cl. ..... 15/167.2; 15/201; 15/203; 15/172; 15/144.1

[58] Field of Search ..... 15/167.1, 167.2, 201, 15/203, 172, 202, 185, 171, 144.1, 159.1, 160, 106

[56] References Cited

U.S. PATENT DOCUMENTS

| | | | |
|---|---|---|---|
| 569,870 | 10/1896 | Hamilton | 15/167.2 |
| 998,500 | 7/1911 | Green et al. | 15/201 |
| 1,091,291 | 3/1914 | Carroll | 15/167.2 |
| 1,133,930 | 3/1915 | Carroll | 15/167.2 |
| 1,307,530 | 6/1919 | Wolf | 15/203 |
| 1,353,780 | 9/1920 | Mueller | 15/167.2 |
| 1,389,624 | 9/1921 | Carroll | 15/167.2 |
| 1,611,573 | 12/1926 | Woodrow | 15/201 |
| 1,668,216 | 5/1928 | Noel | 15/201 |
| 1,748,895 | 2/1930 | Noel | 15/167.2 |
| 2,077,392 | 6/1935 | Boyd | 15/167.2 |
| 2,232,269 | 2/1941 | Reuben | 15/172 |
| 3,067,447 | 7/1959 | Birch | 15/167.2 |
| 3,707,013 | 12/1972 | Erkers | 15/203 |
| 4,131,967 | 1/1979 | Northemann et al. | 15/167.2 |
| 4,449,266 | 5/1984 | Northemann et al. | 15/167.2 |

FOREIGN PATENT DOCUMENTS

| | | | |
|---|---|---|---|
| 659502 | 6/1929 | France | 15/201 |
| 283131 | 4/1945 | Germany | 15/172 |
| 2608532 | 9/1977 | Germany . | |
| 3241118 | 8/1984 | Germany . | |
| 3415735 | 10/1985 | Germany | 15/167.2 |
| 3703288 | 8/1988 | Germany . | |
| 332091 | 10/1958 | Switzerland . | |
| 366382 | 2/1932 | United Kingdom . | |
| 482788 | 4/1938 | United Kingdom . | |
| 831312 | 3/1960 | United Kingdom . | |
| 1552938 | 9/1979 | United Kingdom . | |
| 2192784 | 1/1988 | United Kingdom . | |
| 9001281 | 2/1990 | WIPO | 15/167.2 |

*Primary Examiner*—Gary K. Graham
*Attorney, Agent, or Firm*—Brumbaugh, Graves, Donohue & Raymond

[57] ABSTRACT

A toothbrush split axially into two halves which are hinged together along their length. The toothbrush can be used in a first position as a conventional toothbrush and can be pivoted to a second position wherein the bristles on the heads extend towards one another.

1 Claim, 2 Drawing Sheets

FOLDABLE TOOTHBRUSH

BACKGROUND OF THE INVENTION

The present invention relates to a toothbrush of the kind having a pair of heads capable of cleaning two sides of a tooth simultaneously.

Toothbrushes are known which have two fixed heads which face one another and from which bristles extend towards those of the other head. These toothbrushes have two disadvantages. Firstly, they have a fixed gap between the bristles so that different thicknesses of teeth can not be uniformly cleaned. Secondly, the twin heads make the end of the toothbrush far more bulky than a conventional toothbrush and thus it is difficult to clean one side of a tooth alone.

SUMMARY OF THE INVENTION

According to the present invention, a toothbrush comprises two halves, each consisting of an elongate handle with, at one end a head carrying bristles, the two halves being hinged together using a film hinge about an axis extending substantially parallel to the lengths of the handles; whereby the two halves can be pivoted between a first position in which the heads lie closely side by side with the bristles extending in substantially the same direction, and a second position in which the heads are spaced apart with the bristles of each head extending towards those of the other head; and wherein the end of each half remote from the head is provided with a respective peg positioned such that the spacing between the pegs is the same in the first and second positions, whereby the toothbrush can be held in the first and second positions by a retainer having two sockets which are complimentary to the pegs in the first and second positions.

With this arrangement, the toothbrush can be used in a first position as a conventional toothbrush and in a second position in which the brush can be used to clean two sides of the tooth simultaneously.

BRIEF DESCRIPTION OF THE DRAWINGS

An example of a toothbrush constructed in accordance with the present invention will now be described with reference to the accompanying drawings, in which.

DETAILED DESCRIPTION OF THE PREFERRED EMBODIMENT

Figure 1:
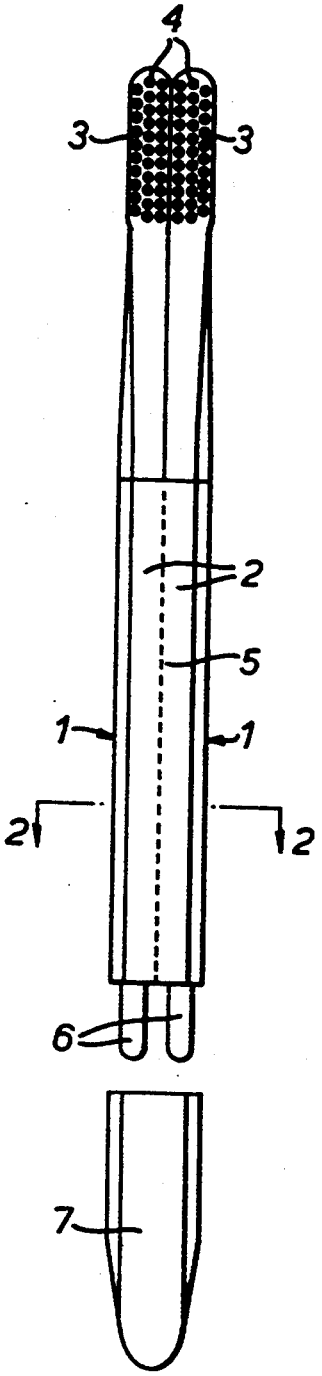
FIG. 1 is a plan view of the toothbrush and retainer in the first position with the retainer detached.
Figure 3:
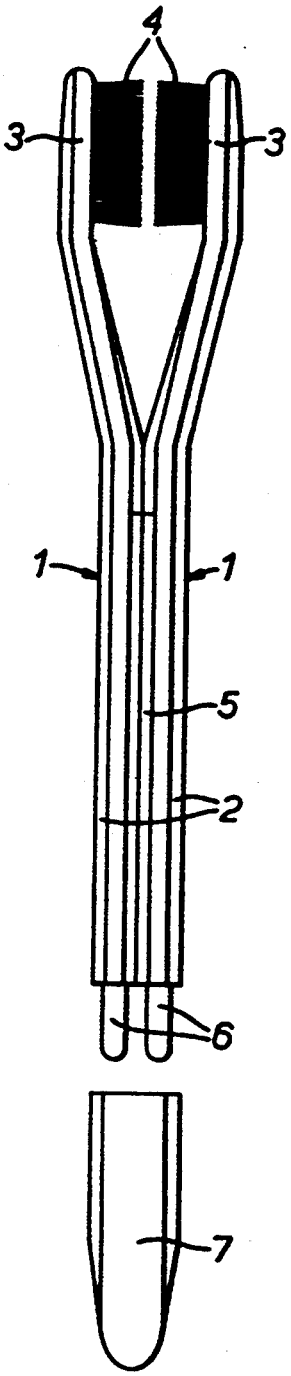
FIG. 3 is a plan view of the toothbrush and retainer in the second position with the retainer detached.
Figure 2:
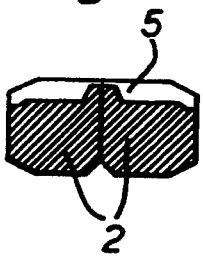
FIG. 2 is an enlarged section along line 2—2 in FIG. 1.
Figure 1A:
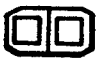
FIGS. 1A and 1B are end views of the toothbrush and retainer respectively with the toothbrush in the first position.
Figure 3A:
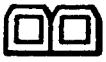
FIGS. 3A and 3B are end views of the toothbrush and retainer respectively with the toothbrush in the second position.
Figure 1B:
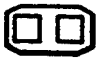
Figure 3B:
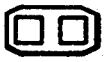

The toothbrush shown in FIGS. 1 to 3 comprises two symmetrical halves 1 each having a handle 2 with a head 3 at one end. Bristles 4 extend perpendicularly from the heads 3.

The two halves 1 are joined by a film hinge 5 attached to the top surface and along the length of the handle as shown in FIGS. 1 and 2.

Figure 4:
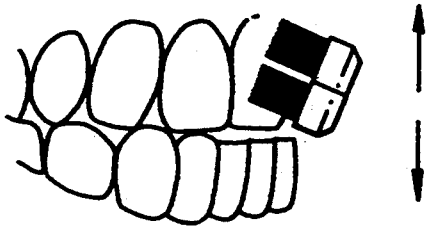
FIGS. 4 and 5 show the toothbrush in use in the first position.
Figure 5:
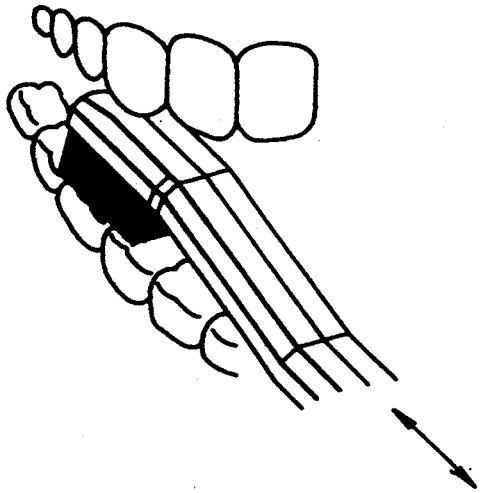

In the first position, the heads 3 of the two halves 1 lie side by side, with the bristles 4 of both halves being parallel. The toothbrush may be used in this position as shown in FIGS. 4 and 5 as a conventional toothbrush.

Figure 6:
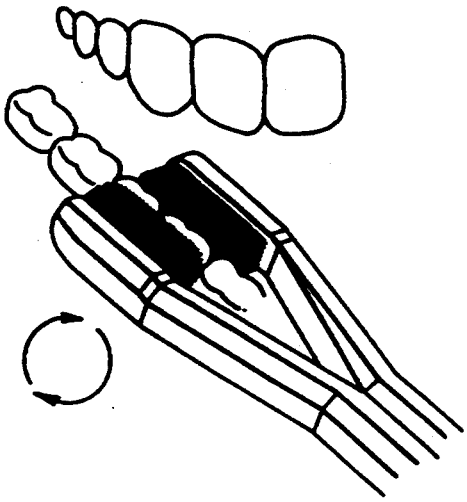
FIGS. 6 and 7 show the toothbrush in use in the second position.
Figure 7:
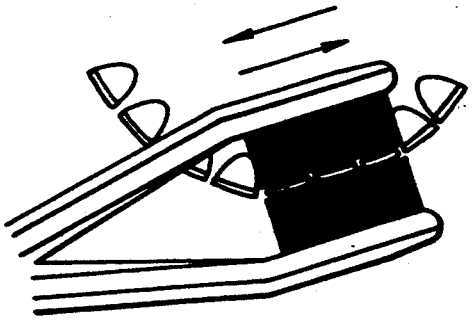

If it is desired to simultaneously clean two surfaces of a tooth, the toothbrush can be easily manipulated into the second position. The two halves 1 of the toothbrush are rotated about the flap hinge into the position shown in FIG. 3. The heads 3 face each other and the bristles 4 extend into the gap between the heads. It can be used to brush teeth in the manner shown in FIGS. 6 and 7.

The end of each half 1 is provided with a peg 6. The positioning of the pegs 6 is such that in the first and second position, the distance between the pegs is the same.

A retainer 7 is provided with two sockets which are complimentary to the pegs and can be fitted over the pegs in the first and second positions. The retainer 7 is press fitted onto the pegs 6 in order to hold the toothbrush in one position. It has to be removed before moving the toothbrush to the other position whereupon it can be replaced to hold the toothbrush in the second position.

I claim:

1. A toothbrush comprising two halves (1), each consisting of an elongate handle (2) with, at one end a head (3) from which bristles (4), extended the two halves being hinged together by a film hinge (5) about an axis extending substantially parallel to the lengths of the handles; such that the two halves can be pivoted about said hinge between a first position in which the heads lie closely side by side with the bristles extending in substantially the same direction, and a second position in which the heads are spaced apart with the bristles of each head extending towards those of the other head; and wherein on the end of each handle remote from the head there extends, a respective peg (6) positioned such that the spacing exists between the pegs which is the same in the first and second positions, means for holding the toothbrush in the first and second positions, said means comprising a retainer (7) having two sockets therein which are complementary to the pegs and receive said pegs in the first and second positions.

* * * * *

UNITED STATES PATENT AND TRADEMARK OFFICE

CERTIFICATE OF CORRECTION

PATENT NO. : 5,432,971

DATED : July 18, 1995

INVENTOR(S) : Angelika Y. B. Chung

It is certified that error appears in the above-indentified patent and that said Letters Patent is hereby corrected as shown below:

Title page; Item [22] "PCT filed December 21, 1992,";

Item [86],
"PCT No. PCT/GB92/02366
§ 371 Date 05 Oct. 1994
§ 102(e) Date 05 Oct. 1994"

Col. 2, line 44, "bristles (4), extended" should read --bristles (4) extend,--.

Col. 2, line 55, "the spacing" should read --a spacing--.

Signed and Sealed this

Nineteenth Day of March, 1996

*Attest:*

Bruce Lehman

BRUCE LEHMAN

*Attesting Officer*

*Commissioner of Patents and Trademarks*